United States Patent [19]

Cumbers

[11] 4,035,219

[45] July 12, 1977

[54] BONDING OF STRUCTURES

[75] Inventor: David Charles Cumbers, Pontypool, England

[73] Assignee: Imperial Chemical Industries Limited, London, England

[21] Appl. No.: 697,587

[22] Filed: June 18, 1976

Related U.S. Application Data

[63] Continuation of Ser. No. 569,633, April 18, 1975, abandoned.

[51] Int. Cl.[2] ..... B32B 31/20

[52] U.S. Cl. ..... 156/290; 28/100; 156/166; 156/306; 428/288; 428/296; 428/373

[58] Field of Search ..... 156/290, 166, 306, 209, 156/219; 28/72 NW; 19/161 R; 428/288, 296, 373

[56] References Cited

U.S. PATENT DOCUMENTS

| | | | |
|---|---|---|---|
| 3,912,567 | 10/1975 | Schwartz | 428/288 |
| 3,920,874 | 11/1975 | Dempsey et al. | 428/288 |

*Primary Examiner*—Edward G. Whitby

*Attorney, Agent, or Firm*—Andrew F. Sayko; Roderick B. Macleod

[57] ABSTRACT

A non-woven structure, method and apparatus for producing non-wovens; the structure having 1) between about 50 and 1000 bond points per square inch, 2) bond points with a cross sectional area of from about $1 \times 10^{-5}$sq. ins. to about $1 \times 10^{-3}$sq. ins. and 3) a bonded area of from about 1% to 20% of the total area; the process comprising forming a non-woven structure which is then passed through a pressure nip comprising a bonding member and a backing member.

2 Claims, No Drawings

BONDING OF STRUCTURES

This application is a continuation of application Ser. No. 569,633 filed Apr. 18, 1975, now abandoned.

BACKGROUND

The invention relates to novel and improved non-woven structures and methods and apparatus for producing such structures and is particularly concerned with bonded non-woven fabrics having a predetermined pattern of spaced bonded area separated by substantially unbonded areas.

Many attempts to produce non-woven fabrics having good handle, drapeability, strength and abrasion resistance are known. Amongst these methods may be mentioned the forming of a homogeneous fibrous web which is then bonded by the application thereto of heat or heat and pressure between platens or nip rollers to cause the fibre to soften and bond with contiguous fibres. The method suffers from the disadvantage that extremely precise control of the bonding operation is required in order to obtain a correctly bonded fabric since if the conditions are not strictly adhered to either a weakly bonded structure with low abrasion resistance and strength is obtained, or else an undrapeable, harsh to handle structure caused by the substantial loss of fibrous form is obtained.

An improved method of bonding is to impregnate the fibrous web with suitable adhesives, gum, resins and the like. Whilst the strength and abrasion resistance are undoubtedly improved, the bonded fabric so obtained has poor drapeability and harsh handle because of the uncontrollable spread of adhesive throughout the structure. It is also known to incorporate the binding medium in fibrous form (in addition to non-binder fibres) in non-woven fabrics and to submit such fabrics to a treatment to render the binder fibres adhesive whilst leaving all other non-binder fibres unaffected, thus bonding the fibres of the fabric together. However, the fabrics bonded by such a method similarly have poor drapeability and a harsh handle caused by loss of fibrous form of the binder fibres when subjected to the bonding process with consequent spread of the binder throughout the fabric.

The drape and handle of bonded non-woven fabrics can be somewhat improved if the fabrics although completely bonded are produced with regions which are less strongly bonded than are other regions. Thus, in a bonding process utilizing heat and pressure, if at least one of the rollers applying pressure to the non-woven structure has a patterned surface, a bonded fabric of fairly good drape and handle will be obtained, since the fabrics bonded by the use of such rollers have regions which are less strongly bonded than others, the more strongly bonded regions being the result of direct contact between the parts of the pattern in relief and the fabric, and the less strongly bonded regions being the result of heat radiation from the other parts of the roller which are not in contact with the fabric. However, the overall bonding i.e. the presence of the less strongly bondedregions as well as the strongly bonded regions, results in fabric properties which are still not the most desirable.

SUMMARY OF THE INVENTION

We have now found that if a bonding member is provided with projections of certain defined dimensions, which projections are present in certain defined numbers per unit area, thus the temperature of the projections and the structure compressed beneath them in a nip can be advantageously raised above the temperature of the remainder of the structure and bonding member by work done by the projections to compress the structure and one aspect of this invention is based on this discovery.

According to one aspect of this invention there is provided a novel method of producing a structure comprising at least a proportion of a thermoplastic material by bonding in a predetermined pattern of spaced binder areas by passing the structure through a pressure nip comprising a bonding member and a backing member wherein the bonding member is heated to a temperature lower than the softening point of the thermoplastic material and which has a surface with i. between about 50 and 1000 projections per square inch projecting therefrom, preferably between about 75 to 700 projections per square inch, and most preferably between about 100 and 400 projections per square inch ii. projections having tips with a cross-sectional area having from about $1 \times 10^{-5}$ sq. in. to $5 \times 10^{-4}$ sq. in., preferably from about $5 \times 10^{-5}$ sq. in. to $4.5 \times 10^{-4}$ sq. in., most preferably from about $1 \times 10^{-4}$ sq. in. to $4 \times 10^{-4}$ sq. in.

iii. projections having a length such that the surface of the bonding member between the projections exerts substantially no pressure on the structure, and iv. projections which penetrate the structure to a depth from 50% to 98%, preferably from about 75% to 95% of the thickness of the structure.

v. projections having a projection angle (hereinafter defined) from about 0° to 100°, preferably from 1° to 60°.

vi. between about 1% and 10%, preferably between about 2% and 5% of the total area of the area of the bonding member comprising the projection tips.

According to another aspect of this invention there is provided a novel apparatus for bonding non-woven structures which comprises a plurality of members forming a pressure nip, at least one of the members being heated and which has a surface with i. between about 50 and 1000 projections per square inch projecting therefrom, preferably between about 75 to 700 projections per square inch, and most preferably between about 100 and 400 projections per square inch ii. projections having tips with a cross-sectional area having from about $1 \times 10^{-5}$ sq. in. to $5 \times 10^{-4}$ sq. in., preferably from about $5 \times 10^{-5}$ sq. in. to $4.5 \times 10^{-4}$ sq. in., most preferably from about $1 \times 10^{-4}$ sq. in. to $4 \times 10^{-4}$ sq. in.

iii. projections having a length such that the surface of the bonding member between the projections exerts substantially no pressure on the structure, and iv. projections which penetrate the structure to a depth from 50% to 98%, preferably from about 75% to 95% of the thickness of the structure.

v. projections having a projection angle (hereinafter defined) from about 0° to 100°, preferably from 1° to 60°.

vi. between about 1% and 10%, preferably between about 2% and 5% of the total area of the area of the bonding member comprising the projection tips.

In addition, the bonding member should be non-deformable under normal conditions and possess good thermal conductivity. Examples of suitable materials for the bonding number are: low or medium carbon steel, high strenght bronze, or high strength aluminium alloys.

The bonding member is associated with a co-operating, backing member. This backing member should be sufficiently elastic to allow for equalised pressure across the face of the member, but hard enough to allow for the generation of sufficient pressure.

In producing non-wovens which are especially suited for textile applications, such as in clothing, it is important that the non-wovens have a suitable combination of good handle, drape-ability, strength and abrasion resistance. According to one aspect of this invention, it has been discovered that suitable textile products are obtained from non-woven webs having the following properties:

1. having between about 50 and 1000 bond points per square inch, preferably between about 75 and 700, and most preferably between about 100 and 400 bond prints per square inch;
2. having bond points wherein the cross sectional area of the tips of the bond points ranges from about $1 \times 10^{-5}$ sq. ins. to about $1 \times 10^{-3}$ sq. ins., preferably from about $5 \times 10^{-5}$ sq. ins. to $9 \times 10^{-4}$ sq. ins., and most preferably from about $1 \times 10^{-4}$ sq. ins. to $8 \times 10^{-4}$ sq. ins., wherein the cross sectional area of the bond points corresponds substantially to the cross section area of the projection tips of the bonding member such that this cross sectional area does not exceed more than about 4 times, and preferably less than 2 times, the cross sectional area of the projection tips;
3. having a bonded area, i.e. the cross sectional area of the bond point multiplied by the number of bond points per unit area, which is from about 1% to 20% of the total area and preferably from about 2% to 10%.

The bond points preferably penetrate the non-woven web to a depth of from about 50% to 98%, preferably from about 75% to 95% of the web thickness. The area between bond points ideally does not increase in density, but in practice the density of the non-woven web between bonds preferably is less than about 2 times the original density of the web, most preferably from about 1 to 1.5 times the original density. The indentations which result from the penetration of the projections on the bonding roll are each preferably defined by an interface which corresponds to the projection angle of the projections on the bonding roll. i.e. an angle of from about 0° to 100°, preferably from about 1° to about 60°.

The defined ranges of the numbers per unit area and dimensions of the projections used in the present invention enable lower average roll temperatures to be used for bonding than has been possible hitherto, which temperatures are lower than the bonding temperature of the structures, the structure compressed beneath tips of the projections being raised to the bonding temperature by virtue of the work done in the pressure nip. Structures which have good strength, drape ability, handle and abrasion resistance are produced by this method since the regions of the structures not contacted by the projections are not bonded by compression, nor by radiant heat from the parts of the roll between the projections, the temperature of these parts not being high enough to effect bonding.

The projections should not have a larger cross-sectional area than about $5 \times 10^{-4}$ sq. ins. since otherwise the differential heating effect cannot be obtained without application of extremely high pressure to the rolls or without sacrificing fabric strength by spacing the projections widely apart and the projections should not have a smaller cross-sectional area than about $1 \times 10^{-5}$ sq. ins. since otherwise the fabric and the projections may be easily damaged.

The length of the projections will be dependent on the thickness of the structure to be bonded such that the projections penetrate the structure to a depth from about 50% to 99% of the thickness but should not be of such a length that heat transmitted from the body of the roll should be lost to any substantial extent or that they are easily damaged. We have found lengths of between about 0.02" and 0.10" are preferred.

The number of projections used will depend on the properties desired in the final product, and on the size of the projections so that the bonded area of the final product comprises 1% to 20% of its total area. For instance, if relatively large projections are desired, there should be a relatively small number thereof per square inch, since otherwise the areas of the final product bonded thereby will be so close together as to cause excessive constraint on the free fibres of unbonded areas of the product causing a low drapeability. On the other hand, if the bonded areas are spaced too far apart, the strength and abrasion resistance of the product are diminished. Furthermore, the number of projections and size thereof should be chosen so that the desired differential heating effect is obtained whilst producing the required properties of the product.

It is believed that, although the heat and pressure which effect the bonding of the structure are most effective at the tips of the projections, there is additional bonding in the final product caused by the walls of the projections. This additional bonding increases as the projection angle increases, and the bonded area of the final product may be as much as four times, but preferably less than twice, the projection tip cross-sectional area.

The properties of the product are further affected by the choice of the angle included by opposite walls of the projections, referred to as the projection angle. The elevation of temperature above the nominal temperature of the roll of any point on a projection is roughly proportional to the amount of work done by that point in compressing the structure in the pressure nip, i.e., the maximum temperature elevation will be achieved by those points which do the most work, to which the most intensely bonded portions in the final product will correspond. If the projection angle is small or zero an extremely localized bond will be formed, but with too large a projection angle a different type of bonded area will be formed in which there is a strongly bonded centre region (corresponding to the tip of the projection), with a large peripheral region of less strongly bonded fabric. The intensity of bonding decreases as the distance from the central region increases (corresponding to the sloping walls of the projection) since the work done in the nip of compressing the structure by the sloping walls will be less than that done by the tip of the projection. We have found that the two types of bond affect the flexibility and strength of the fabric. The projection angle therefore preferably ranges from about 0° to 100°, and most preferably from about 1° to 60°.

The cross-sectional shape of the projections can have any desired form providing that the projections do not damage the structure to be bonded or the backing member. Hence when in this specification we speak of the cross-sectional area of the tips of the projections we mean the area at the section across the domed projection where doming commences or, if the projections are not domes, the cross-sectional area at the outer end of the projections.

Although it is preferred, there is no necessity for all the projections to have the same cross-sectional size and shape, projection angle, or spacing. Extremely useful fabrics may be produced with regularly spaced projections having the same dimensions. Pattern effects may be achieved by the method of the invention by, for example, variation of the numbers of projections per unit area, or by arranging different sizes of projections to be grouped in different areas.

The backing member is preferably smooth and may be made of any material but we have found that a member having an elastic surface is especially useful in carrying out the present invention since such a member tends to distribute the load applied more effectively and prevents damage to the projections. The backing member may be heated and in some cases this may aid processing, but care should be taken that its temperature is not as high as the softening point of the material being processed.

A particularly useful structure which may be bonded by the method of the invention is a fibrous non-woven web. Staple fibre webs, continuous filament webs and continuous filament yarn webs are all suitable for use in the present invention, but continuous filament webs are preferred. The webs may be fabricated in a number of known ways, and the method selected will depend to a large extent on the type of fibrous form selected. The webs may be processed as fabricated, or a subsidiary step, such as, needle-punching the web may be carried out before bonding according to the method of the invention.

The fibrous web may be composed of any conventional thermoplastic textile fibre, either alone or as a blend with other fibres, for example a non-thermoplastic fibre or natural fibres such as cotton or wool. Particularly suitable fibres are those formed from polyamides, for example poly(hexamethylene adipamide), poly(hexamethylene sebacamide), poly(epsilon-caprolactam), and copolymers of these or other polyamides, and polyesters, for example polyethylene terephthalate.

Other useful fibres for use in the fibrous assembly are multi-component filaments, which conveniently comprise at least two synthetic polymer components at least one of which can be rendered adhesive under conditions which leave the other component or components substantially unaffected, the potentially adhesive component occupying at least a proportion of the peripheral surface of the filament. If the components of such filaments are in a side-by-side arrangement then the fabric may be trated before or after bonding to develop crimp.

It is not neccessary to carry out the process of this invention on a single fibrous structure. The structure may be made up of a number of fibrous assemblies which may or may not have already been subjected to a bonding action before the process of this invention is performed on it. Similarly, the method of the invention may be used to effect bonding between a fibrous assembly and a non-fibrous assembly, to provide a backing material for the non-fibrous assembly.

The fibrous assembly may also incorporate reinforcing members such as scrim fabrics to increase the strength of the structure.

The structure produced by the process and apparatus of the invention need not be a fibrous assembly but could be for example two woven fabrics containing theremoplastic components, of different appearance which could be bonded by the method of the invention to provide a lined fabric for garments or a reversable fabric.

Whatever the composition of the structure, the bonding temperature is usually taken as the softening point of the component which has the lowest softening point. This component, since it is the one which will be utilised to form bonds by the practice of the present invention, should be present in the fibrous web in at least 5% and preferably 20% to 100% by weight.

The invention will now be described in more detail with reference to the following examples which are in no way intended to limit the scope of the invention.

In the examples and other parts of the specification various properties of the products are quoted. These properties were measured as follows:-

Breaking Load

The Breaking Load of the fabric was measured on a 2.5 cm. wide strip of fabric using an INSTRON Tensile Tester (INSTRON is a Registered Trade Mark) with jaws set initially 10 cms. apart and moved apart at 10 cms/min.

Rip Tear Strength

The Rip Tear Strength of a 5 cm. wide strip of the fabric, 10 cm. long and having a slit 7.5 cm. long down the middle was also measured on a INSTRON Tensile Tester by clamping the two ends of the fabric divided by the slit between jaws of the tester set initially 5 cms. apart and moving the jaws apart at 10 cm/min. to extend the slit.

Flexural Rigidity

Flexural Rigidity is a measure of the fabric stiffness or flexibility and is related to the quality of stiffness that is appreciated on handling the fabric, and its measurement involves determining the length of fabric which is necessary to cause the fabric to bend from the horizontal plane when under no constraint to such an extent as to contact a plane surface inclined at an angle of 41.5° to the horizontal. The procedure is fully described in British Standard Specification No. 3356/1961. Briefly stated, it comprises placing a one inch wide strip of the fabric upon a horizontal surface, one end of which abuts against the top end of a 41.5° inclined plane. The test sample is placed with its narrow edge at the juncture of the horizontal and inclined surfaces. It is then moved forward over the edge between the two surfaces until the free end bends over and contacts the inclined surface. The length of the aro (cantilever length) between the point of departure from the horizontal surface and the point of contact with the inclined surface is measured and half of this length is known as the Bending Length. The flexural rigidity may be calculated from this bending length and the weight per unit area of the fabric by using the formula Flexural Rigidity = 0.1 ($W \times C^3$)
where W is the weight per unit area of fabric in gms./sq.m and C is the bending length in cm.

EXAMPLE 1

A web of randomly laid continuous filaments of poly(hexamethylene adipamide) weighing 1.6 ounces per square yard was passed through a pressure nip formed by an unheated roll having a cover of cotton impregnated with size to give it a smooth surface and a heated roll having a soft steel surface provided with cylindrical projections having a cross-sectional area of approximately $3 \times 10^{-4}$ square inches and 0.03 to 0.04 inches length and having domed tips there being about 130 projections per square inch of surface. The surface temperature of the heated roll was 210° C and a pressure of 2,300 lbs/ft. width of nip was applied to the nip.

The resulting product was a strong yet drapeable non-woven fabric having a very attractive handle. The area bonded was found to be about 8% of the total area.

The fabric had the following properties:
Breaking Load (KG) . . . . 1.02
Rip Tear Strength (Kg) . . . . 1.03
Flexural Rigidity (Mg.cm) . . . . 40

EXAMPLE 2

This example illustrates the effects on fabric properties of the number of projections per sq. in. A web comprising bicomponent (65% core - 35% sheath) continuous filaments, having a core of nylon 6.6 and a sheath consisting of a copolymer of 70% nylon 6.6 and 30% nylon 6, was prepared by the method described below.

A polymer of nylon 6.6, having a relative viscosity of between 38 to 42, and containing 0.3% titanium dioxide as a delustrant, and a copolymer of 70% nylon 6.6 and 30% nylon 6, having the same relative viscosity and delustrant content as the nylon 66 polymer were melted in separate screw extruders and pumped to a core-sheath composite filament extrusion unit such as that described in BRitish Pat. No. 1,100,430. The temperature of extrusion was 275° C for both polymer streams. The polymer streams were pumped at rates which produced 65% nylon 66 as core and 35% nylon 6.6/6 as sheath in the filaments extruded from the spinneret. The spinneret had 40 circular holes having a diameter of 0.015 inches and the filtration pack was composed of 30 grade aluminium.

The filaments were cooled and converged at a guide 6 feet 6 inches below the face of the spinneret. 10 feet below this guide was an air ejector as described in British Pat. No. 1,088,851. The air ejector sprayed the filaments on to an advancing continuous foraminous sheet conveyor situated 30 inches below the air ejector, which was arranged to traverse at a continuous speed in a direction perpendicular to the direction of advance of the conveyor. The speeds of traverse of the air ejector and of advance of the conveyor were adjusted to give a randomly laid web of uniform weight per unit area.

By this method an unbonded web having a weight of 1.7 ounces per square yard was prepared.

A portion of the web was passed through a pressure nip formed by a roll having a cover of cotton impregnated with size to give it a smooth surface maintained at a surface temperature of 110° C ± 5° C and a heated bonding roll provided with projections of a square cross-section of tip area approximately $5 \times 10^{-5}$ square inches and of 0.03 - 0.04 inches length, there being about 650 projections per square inch of surface, the projections having a projection angle of about 60°. The surface temperature of the bonding roll was maintained at 180° (about 25° below the softening point of the nylon 6.6/6 copolymer) and a pressure of 4,500 lbs/ft. width of nip was applied to the nip. The web was fed through the nip at a rate of 20 feet per minute.

The resulting fabric was strong and had acceptable drape with an attractive handle. The bonded area of the fabric accounted for about 7% of the total area, and the bond penetrated to about 75% of the depth of the fabric. The fabric was considered suitable for use in such varied uses as bed sheets, underwear and as a substrate for a coated fabric for rainwear. It had the following properties:
Breaking Load (Kg) . . . . 4.5
Rip Tear Strength (Kg) . . . . 1.2
Flexural Rigidity (Mg.cm) . . . . 154

To illustrate the adverse effect on the overall properties of the product of excessive numbers of projections per square inch a portion of the web described above was passed through the same pressure nip under the same temperature conditions, the projections having the same dimensions as above but being arranged at a density of 1,200 per square inch. Although the percentage area bonded was about 15%, the bond points were in such close proximity that all fibrosity was lost, but when elastic roll temperature was reduced to 80° C and the nip pressure to 3,500 lbs/ft. length of nip, a fabric with extremely low tear strength and extremely papery handle was formed. The product was considered useless for textile end-uses and had the following properties:
Rip Tear Strength (kg) . . . . 0.2
Flexural Rigidity (Mg.cms) . . . . 110

EXAMPLE 3

This example illustrates the effect of the projection angle and the size of tip area on fabric properties.

Two webs were fabricated from bicomponent fibres as described in Example 2, having weights of 1.7 ounces/square yard (referred to hereinafter as Web A), and of 3.5 ounces/square yard (referred to hereinafter as Web B).

Portions of both webs were then bonded according to the method described in Example 2, the elastic backing roll being maintained at a surface temperature of 110° C and the nip pressure at 4,500 lbs per foot width of nip. In this case the process roll had 250 projections per square inch, the projections were of square cross-section with a tip area of about $3 \times 10^{-4}$sq. inches, the projection angles being about 60° C and the nominal temperature of the bonding roll was maintained at 180° C. Thus the percentage area of the roll surface accounted for by the projection tips was about 7.5%.

The products of both webs had attractive handle, drape and abrasion resistance and good strength. The percentage bonded area was about 15% of the total area, and the bond point tips were situated at a depth of about 80% of the depth of the fabric. The indentations which resulted from the penetration of the projections on the bonding roll were found to have interfaces with angles of about 65°, corresponding closely to the projection angles.

The product of Web A was considered suitable for such end-uses as lightweight dress-wear and underwear, whilst the product of Web B could be used for children's wear, etc., of sound wearing performances.

The properties of the products were:

| | Web A | Web B |
|---|---|---|
| Breaking Load (Kg.) | 3.6 | 10.2 |
| Rip Tear Strength (Kg) | 1.2 | 2.9 |
| Flexural Rigidity (Mg . cms) | 90 | 670 |

The initial density of the unbonded Web B ws 0.2 g/co, and the density of the unbonded portions of Web B after the bonding process was found to be 0.26 g/co, indicating that the effect of the bonding step on the unbonded regions was comparatively insignificant.

Further portions of Webs A and B were then subjected to a bonding treatment substantially as described above except that the tip area of the projections was 6 $\times 10^{-4}$ square inches and the projection angle was about 120°.

Thus, the percentage area of the bonding surface accounted for by the cross-sectional area of the tips of the projections was about 15%.

The products had a harsh handle and low tear strength. The bonded area of the product was found to be around 30% of the total area. The products have insufficient resistance to normal "wear and tear" in use. This feature has been found to worsen with increasing tip area, increasing projection angle and increasing web weight.

The properties of the product were:

| | Web A | Web B |
|---|---|---|
| Breaking Load (Kg) | 4.1 | 10.2 |
| Rip Tear Strength (Kg) | 0.6 | 1.7 |
| Flexural Rigidity (Mg . cm) | 145 | 1000 |

EXAMPLE 4

A randomly laid web of nylon 6.6 filaments was prepared by the following route.

A polymer of nylon 6.6, having a relative viscosity of between 38 to 42, and containing 0.3% titanium dioxide as a delustrant, was extended at an extrusion temperature of 275° from a spinneret having 40 circular holes with a diameter of 0.015 inch.

The filaments were cooled and converged at a guide 6 feet 6 inches below the face of the spinneret. 10 feet below this guide was an air ejector as described in B. Pat. No. 1,088,851. The air ejector sprayed the filaments on to an advancing continuous foraminous sheet conveyor situated 30 inches below the air ejector, which was arranged to traverse at a continuous speed in a direction perpendicular to the direction of advance of the conveyor. The speeds of traverse of the air ejector and of advance of the conveyor were adjusted to give a randomly laid web of uniform weight per unit area.

By this means a uniform unbonded web of nylon 6.6 homofilaments, having a weight of 3–5 ounces per square yard was made, and bonded substantially according to the procedure of Example 2. The projections on the bonding roll were of square cross-section with a tip area of $2 \times 10^{-4}$ square in., there were about 400 projections per square inch of surface, and the projection angle was about 60°. The percentage area of the bonding roll occupied by the projection tips was about 8%. The surface temperature of the process roll was maintained at 210° C, that is about 55° C below the softening point of nylon 6.6. The temperature of the elastic beacking roll was 120° C and the nip pressure was 3,500 lbs/ft. width of nip.

The product had acceptable drape and handle, good tear strength and abrasion resistance and was considered useful for outerwear and and children's wear. The bonded area of the product was about 14% of the total area, and the depth of the bonded area below was about 90% of the thickness of the fabric.

The properties of the product were:

Breaking Load (kg) . . . . 7.4
Rip Tear Strength (Kg) . . . . 3.2
Flexural Rigidity (Mg.cm) . . . . 265

EXAMPLE 5

A portion of Web B of Example 3 was treated according to the process conditions of Example 3. The bonding roll had projections with a tip area of $4.5 \times 10^{-4}$ sq. inches, with 100 projections per square inch. The projection angle of the tips was about 60 ° and the projection tips occupied about 4.5% of the area of the bonding roll.

The resulting fabric was extremely attractive, had good handle with a prominent pattern relief, had excellent tear strength and was eminently suitable for apparel outerwear and domestic uses. The percentage bonded area was about 7.5% of the total area, and the bond point tips were situated at a depth of about 85% of the depth of the fabric. The identations which resulted from the penetration of the projections on the bonding roll were found to have interfaces with angles of about 60°.

The properties of the bonded web were:

Breaking Load (kg) . . . . 9.9
Rip Tear Strength (kg) . . . . 4.2
Flexural Rigidity (Mg.cm) . . . . 390

What we claim is:

1. A method of bonding a non-woven structure comprising at least one thermoplastic material in a predetermined pattern of spaced bond-points which comprises forming a pressure nip formed by a plurality of members at least one of which is a bonding roll provided with projections on its surface, said bonding roll in co-operation with a backing roll, heating said bonding roll to a temperature below the softening point of said thermoplastic material, passing said non-woven structure through the pressure nip, compressing said web between said bonding roll and said backing roll, raising the temperature of said projections and said web to a temperature above the temperature of the remainder of said bonding roll by work done by said projections to compress said web, said bonding roll providing (i) from 50 to 1000 bond points per square inch of said web, (ii) said bond points having bases with a cross sectional area of from $1 \times 10^{-5}$ square inch to $1 \times 10^{-3}$ square inch, (iii) the bases of said bond points lying at a debth of from 50% to 98% of the thickness of said web, (iv) said bond points having an interface angle of from 1° to 60°, (v) said bond points occupying from about 1% to 20% of the total area of said web, simultaneously avoiding contacting said web with the surface of said bonding roll between said projections and substantially avoiding bonding between said bond points, and withdrawing said web as a bonded non-woven structure.

2. The process of claim 1, wherein the area between bonds is compacted to a density of less than four times the initial density of said non-woven structure.

* * * * *